US005372080A

United States Patent [19]

Sewell

[11] Patent Number: 5,372,080

[45] Date of Patent: Dec. 13, 1994

[54] MOTORIZED SAIL TENSIONER FOR WINDSURFING

[76] Inventor: Andrew W. Sewell, 3000 Huntington Rd., Sacramento, Calif. 95864

[21] Appl. No.: 35,176

[22] Filed: Mar. 22, 1993

[51] Int. Cl.[5] ..... B63B 35/79

[52] U.S. Cl. ..... 114/39.002; 114/93

[58] Field of Search ..... 455/100; 114/39.1, 39.2, 114/89, 90, 91, 109, 102, 103; 318/16; 74/424.8 R, 424.8 C; 200/DIG. 2

[56] References Cited

U.S. PATENT DOCUMENTS

| | | | |
|---|---|---|---|
| 3,499,344 | 3/1970 | Pickles | 74/424.8 R |
| 4,426,806 | 1/1984 | Woodworth | 280/213 |
| 4,722,625 | 2/1988 | O'Brien | 200/DIG. 2 |
| 5,134,952 | 8/1992 | Dolittle | 114/90 |

FOREIGN PATENT DOCUMENTS

| | | | |
|---|---|---|---|
| 449711 | 7/1936 | United Kingdom | 114/90 |

*Primary Examiner*—Edwin L. Swinehart
*Attorney, Agent, or Firm*—Jones, Tullar & Cooper

[57] ABSTRACT

A motorized sail tensioner gives the sailor the ability to change the sail shape while sailing, permitting constant adjustment of the sail with only the touch of a switch, to adjust for wind gusts and lulls. It accomplishes this by using a small DC-battery powered motor, assisted by two methods of gear reduction, using a planetary gear and screw. The motor is activated by a remote RF wireless transmitter, worn on the sailors wrist, and activated by a switch, worn on the sailor's index finger. The sail tension is changed by moving the mast position by the action of moving a nut up and down a screw attached to the motor.

2 Claims, 3 Drawing Sheets

FIG. 1
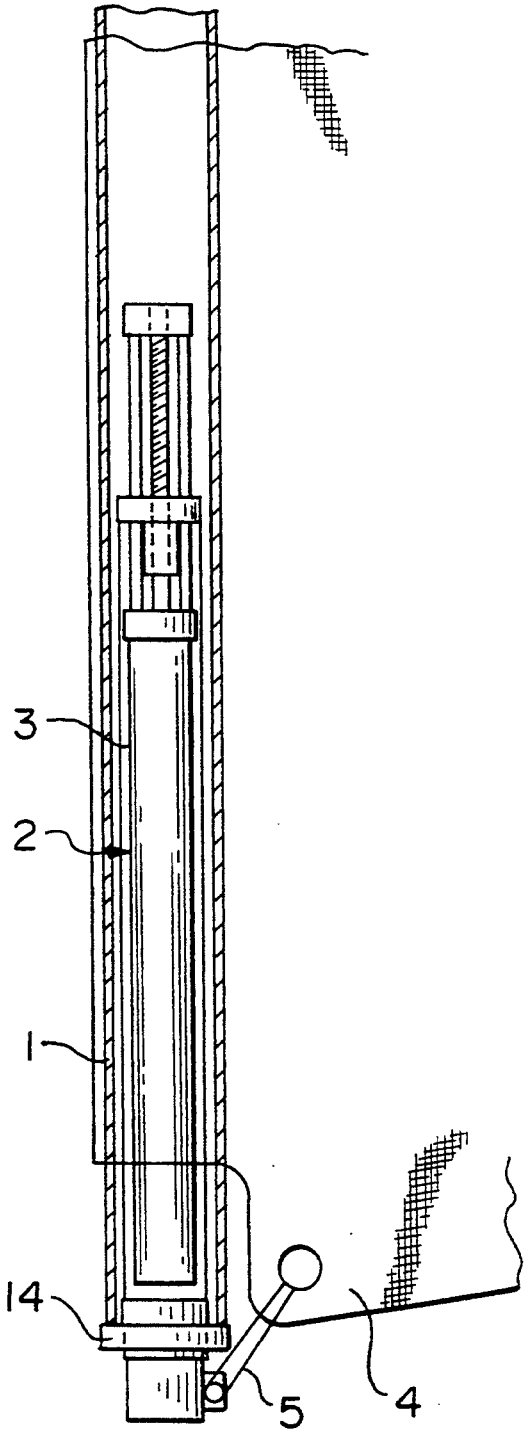
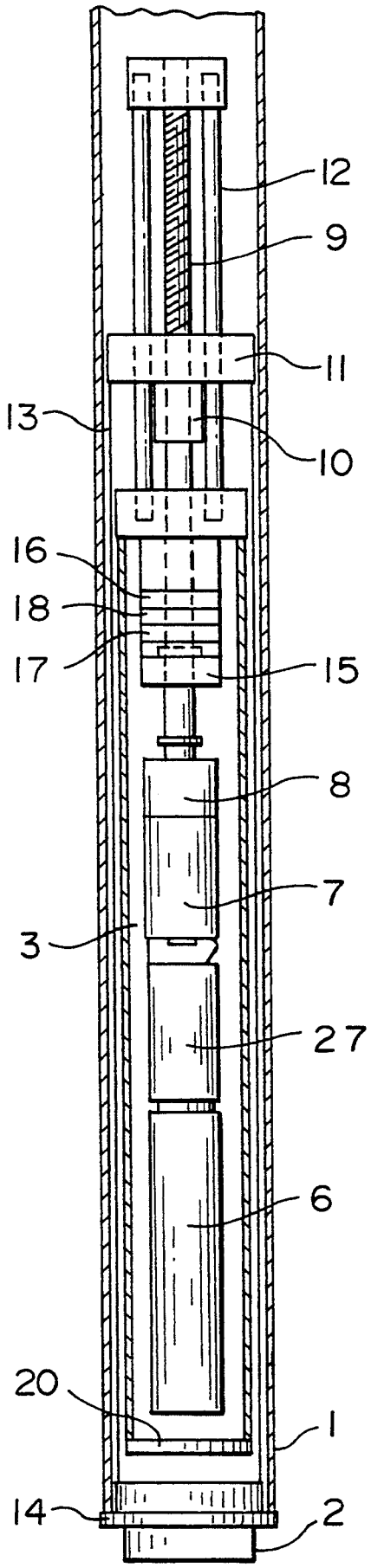
FIG. 2

MOTORIZED SAIL TENSIONER FOR WINDSURFING

FIELD OF THE INVENTION

The present invention is directed generally to a sail tensioning device for windsurfing sails.

More specifically, the present invention is directed to a sail tensioning device for windsurfing sails, utilizing a battery powered,motorized sail tensioner.

Even more specifically, the present invention is directed to a sail tensioning device for windsurfing sails, utilizing a battery powered, motorized sail tensioner, assisted by a combination of gear reductions, specifically, utilizing the combination of a planetary gear and screw.

Most specifically, the present invention is directed to a sail tensioning device for windsurfing sails, utilizing a battery powered, motorized sail tensioner, assisted by combination gear reduction, utilizing a planetary gear and screw, and actuated by a wireless switch worn on the sailor's wrist. This allows the sailor to make adjustment with only a touch of a finger on the button, without disturbing his sailing position while sailing.

The motorized sail tensioner has a waterproof plastic housing that is inserted inside the mast and mast-base assembly. The screw-assembly portion is external to the waterproof section, and extends further up inside the mast. The device is made unobtrusive, and is protected by impact damage, by being wholy contained inside the windsurfing sail's mast.

DESCRIPTION OF THE PRIOR ART

Modern windsurfing sails are semi-rigid foils,that is, they are not soft, loose cloth, but are stiff and rigid, to act more like a rigid airplane wing. Also, the shape of the sail can be changed, to accomodate different wind velocities. The sail's shape is adjusted primarily by changing the downhaul tension, which is the amount of pull on the bottom of the sail. By changing the sail shape, the sail can be used in a wider range of wind velocity. However, sailors cannot fully utilize this adjustability of the sail, because the prior art required the sailor to return to dry land, remove the sail from the board, and pull on the downhaul rope to change its tension. This lengthy procedure made it impossible to change the sail shape to accomodate for short wind gusts, and even impractical to accomodate for major changes in wind velocity, unless they were so significant to make this inconvenient procedure worthwhile.

SUMMARY OF THE INVENTION

It is an object of the present invention to provide a motorized sail tensioner.

Another object of the present invention is to utilize a screw-mechanism to move the mast higher and lower on the mast base tube, to affect sail tension. The screw serves a dual function, first as a mechanical gear reduction device, coupled with the planetary gear for further gear reduction, and secondly, as the movement device, to move the nut up and down, which moves the mast up and down, as described in the detailed description. It is a key feature of the invention that the sail is tightened by movement of the mast, rather than by movement of the sail, thereby not changing the sail's position relative to the windsurfing board. It is generally accepted in the windsurfing industry that the distance between the sail and the windsurfing board remain constant, for reasons of wind flow.

A further object of the invention is to utilize a double-reduction technology, consisting of a planetary gear coupled with a screw, to allow a small, high-speed electric motor to pull a considerable force of up to 200 pounds. An additional feature of the double-reduction technology is to provide sufficient resistance in the gearing to provide anti-creep protection, so the nut won't change position on the screw, under highest tension loads.

Still a further object of the present invention is to allow the sailor to make adjustment with only a touch of a finger on the button, without disturbing his sailing position, by using wireless RF transmission by way of an activation switch worn as a ring on the index finger to activate the device.

Even yet another object of the present invention is to have the entire device enclosed inside the mast/base assembly, for protection from damage, and to avoid excess size added to the windsurfing rig.

The motorized sail tensioner is designed to provide a means to constantly and rapidly change the shape of the sail, to adjust for wind gusts and lulls, without returning to dry land. Furthermore, the action does not even require the sailor to change his body position, he can just touch his thumb to the ring switch worn on his index finger. This allows the sailor to maintain optimum body position on the windsurfing board, which is critical to maintaining maximum board speed.

As will be discussed in greater detail in the description of the preferred embodiment which follows, the motorized sail tensioner utilizes a waterproof plastic housing that encloses the planetary gear,motor, battery, and RF receiver unit. Above the plastic housing is the screw-assembly, consisting of support shafts, and a nut that runs up and down a screw.

BRIEF DESCRIPTION OF THE DRAWINGS

The features of the motorized sail tensioner, as specified in the claims, are illustrated in the accompanying drawings, in which:

FIG. 1 is an overview of the device, showing it as inserted in the sail's mast, and attached to the sail.

FIG. 2 is a full view of the device, showing it's insertion into the mast base and mast.

DETAILED DESCRIPTION OF THE PREFERRED EMBODIMENT

Figure 3:
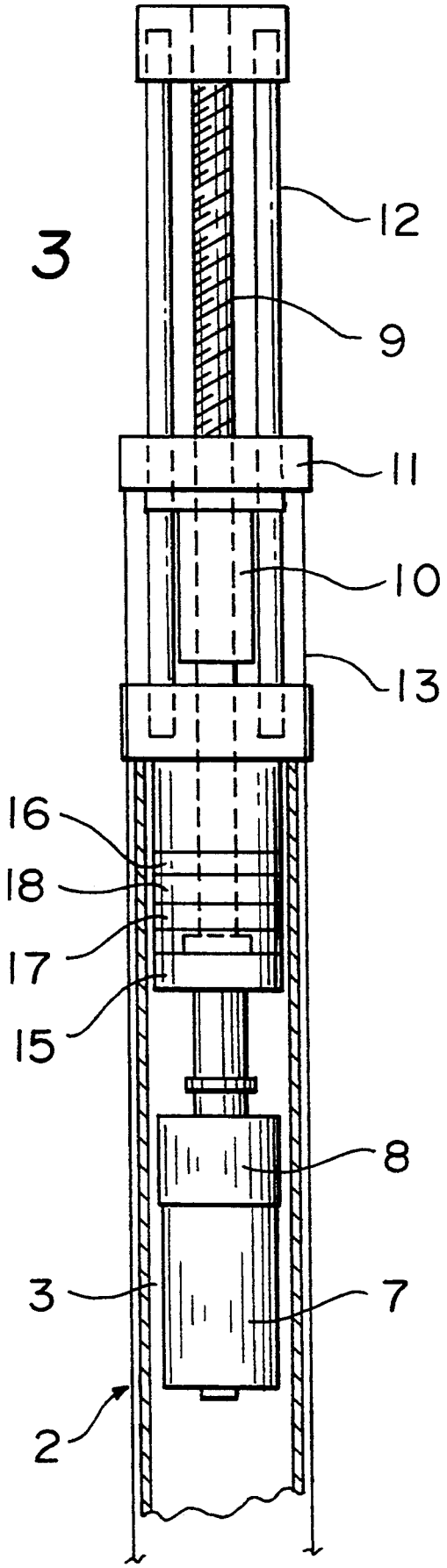
FIG. 3 is a view of the center section,showing the mechanical operations of the device.

Referring initially to FIG. 1 there may be seen, contained inside mast 1, a preferred embodiment of a motorized sail tensioner, in accordance with the present invention. The shape of sail 4 can be adjusted by the amount of tension manually applied to downhaul rope 5. This is the only means of adjusting sail tension, under the prior art, because base ring 14 was fixed. The motorized sail tensioner, shown generally at 2, adds an additional means of changing sail tension, while sailing, by moving base ring 14, which adds tension to sail 4. This tension is increased to sail 4 because mast 1, which is enclosed inside sail 4 is pushed upward from the pressure applied to the top of the sail by the movement of mast 1, and since the sail 4 is held at the bottom by downhaul rope 5, the sail is thereby stretched tighter on mast 1. This ability to easily change sail tension allows the sailor to make constant adjustments to the sail, to change its shape to meet the varying wind gusts and lulls. It is an important feature that the sailor changes sail tension with the touch of a button, without having to alter his position on the windsurfing board to do so. This is important because any change of body position can cause the windsurfing board to fall off a plane, that is, to slow down and sink lower in the water, when wind velocity is reduced.

The sail tensioner is contained entirely inside mast 1, and consists of watertight housing 3, which is contained inside aluminum mast base 2, and an external section, outside watertight housing 3, that extends further inside mast 1. Watertight housing 3 can also be seen in greater detail in FIG. 4.

Figure 4:
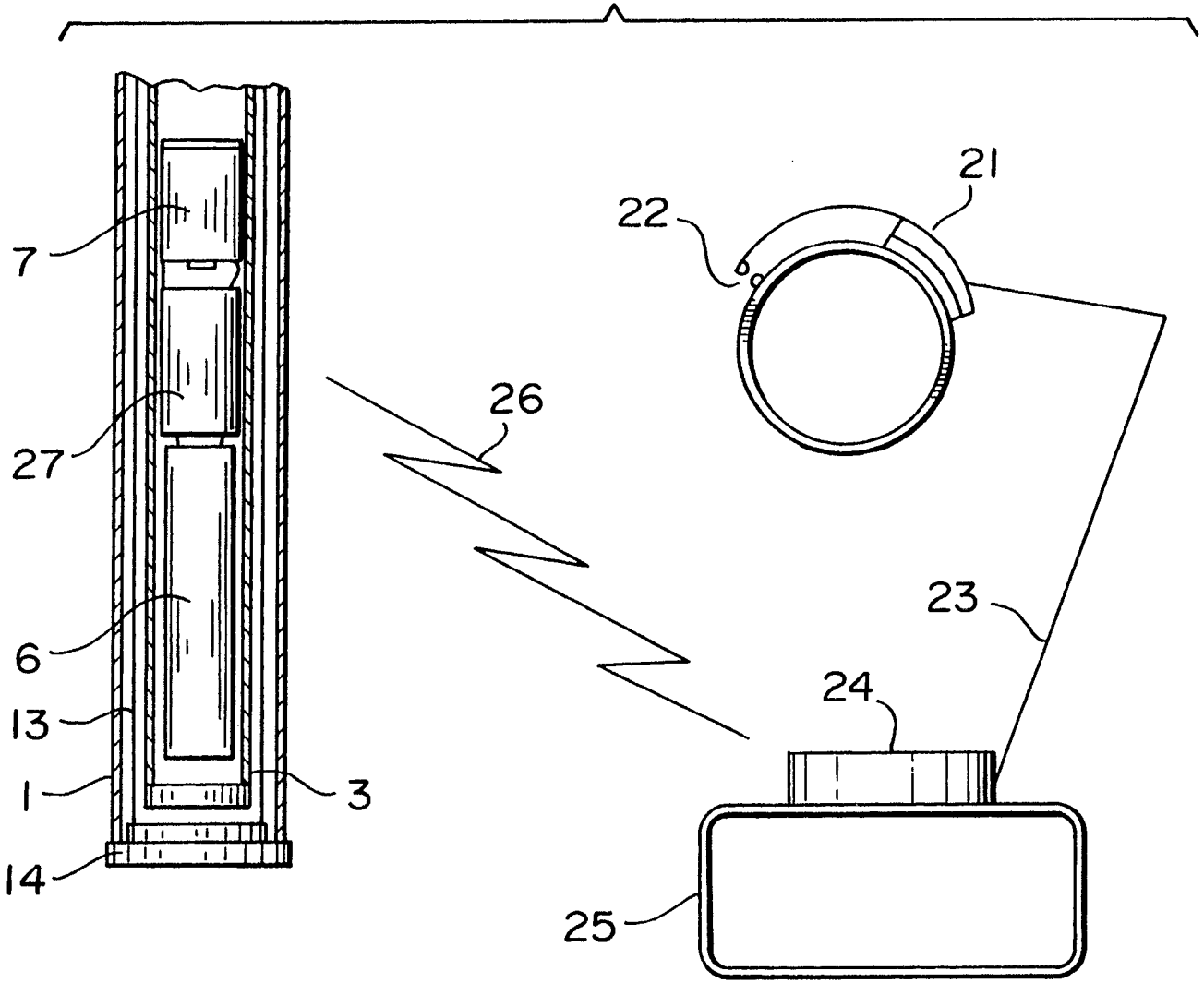
FIG. 4 is a cross-sectional view of the motor, battery, and RF receiver, showing the electrical portion of the device. Also shown is the RF sender, worn as a wrist-unit, and the RF sender switch, worn as a ring on the index finger, capable of activating the screw device in an upward or downward direction.

As shown in greater detail in FIG. 4, pressing ring contacts 22 on ring switch 21 sends signal on ring wires 23 to activate wrist transmitter 24, which sends a signal by RF signal 26 to RF receiver 27. The wrist transmitter is worn on the sailor's wrist by using wrist strap 25, and ring switch 21 is worn on the sailor's index finger, and activated by his thumb. An optional model utilizes physical wiring run up the mast, as an inexpensive alternative to the wireless model.

RF receiver 27 subsequently utilizes power from battery 6 to activate motor 7.

Referring to FIG. 3, which primarily shows the mechanical portion of the device, motor 7 then drives planetary gear 8 which acts as a gear reduction device, which then turns screw 9, which serves a dual purpose as an additional gear reduction device and a method of effecting movement of nut 10. By the turning action of screw 9, the nut 10 is run up or down screw 9, with support rod 12 utilized to prevent nut 10 from spinning.

Referring to FIG. 2, nut 10 has nut plate 11 attached to it, with connecting wires 13 attached to nut plate 11, and running to the bottom section, where connecting wires 13 are attached to sliding base ring 14. A closer view of the connection of connecting wires 13 to base ring 14 can be also seen in FIG. 4. Also shown on FIG. 4, because mast 1 is resting on base ring 14, any movement of base ring 14 will also move mast 1.

Referring back to FIG. 3, screw 9 is resting on bearing 15, which is contained in watertight housing 3, which is made waterproof on top by seals 16 and 17, and grease reservoir 18, and on the bottom by bottom plug 20. The entire waterproof section is contained inside aluminum mast base 2.

What is claimed is:

1. A motorized sail tensioning adjuster usable to change downhaul tension in a windsurfing sail, said sail tensioning adjuster comprising:

a fixed mast base;

a base ring slidably supported on said mast base;

a sail carrying mast supported at a lower end by said slidable base ring;

a battery powered high speed electric motor positioned within a waterproof housing in said lower end of said mast;

a planetary gear positioned within said waterproof housing and driven by said electric motor;

a rotatable screw extending upwardly within said mast from said planetary gear and being rotatable by operation of said motor, said screw and said planetary gear operating as a gear reduction device;

a threaded nut assembly positioned on said screw exterior of said waterproof housing and slidably supported in said mast for translation along said screw during said rotation of said screw; and connecting means extending between said nut assembly and said base ring, said translation of said nut assembly along said screw causing said base ring to slide on said mast base to thereby alter the tension in a sail carried by said mast supported by said slidable base ring.

2. The motorized sail tensioning adjuster of claim 1 further including a seal assembly in an upper portion of said waterproof housing, said rotatable screw passing through said seal assembly and extending upwardly in said mast exteriorly of said waterproof housing.

* * * * *